United States Patent [19]

Graf

[11] Patent Number: 4,851,832

[45] Date of Patent: Jul. 25, 1989

[54] TRAFFIC CONTROL DEVICE FOR STREET VEHICLES

[76] Inventor: Herbert Graf, Freigutstrasse 6 CH-8027, Zuerich, Switzerland

[21] Appl. No.: 104,145

[22] Filed: Oct. 5, 1987

[30] Foreign Application Priority Data

Oct. 6, 1986 [DE] Fed. Rep. of Germany ..... 3633957

[51] Int. Cl.[4] ..... G08G 1/095

[52] U.S. Cl. ..... 340/907; 340/482; 40/446

[58] Field of Search ..... 340/84, 107, 110, 122, 340/124, 144, 145, 146, 815.32, 907, 908; 362/324, 325, 279; 40/446, 450, 554, 491, 451, 452; 116/285, 286, 303

[56] References Cited

U.S. PATENT DOCUMENTS

| | | | |
|---|---|---|---|
| 3,373,402 | 3/1968 | Gervais | 340/107 |
| 3,400,366 | 9/1968 | Downing | 340/124 |
| 3,553,645 | 5/1987 | Finkel | 340/84 |

FOREIGN PATENT DOCUMENTS

| | | |
|---|---|---|
| 1969963 | 2/1967 | Fed. Rep. of Germany . |
| 2208565 | 11/1973 | France . |

*Primary Examiner*—Joseph A. Orsino
*Assistant Examiner*—Brian R. Tumm
*Attorney, Agent, or Firm*—Spencer & Frank

[57] ABSTRACT

The invention relates to a control device for vehicular street traffic, including a signal disc which consumes very little energy. This signal disc is provided with signal webs separated by deep grooves and with a diffusely reflecting color coating. Pivotal slats are disposed in a frame in front of the signal disc. If the signal disc is displaced with respect to the frame, the slats are pivoted upwardly and push themselves completely into grooves. The signal disc is therefore visible at any observation angle. At dusk or at night, the signals may be given by suitably disposed, dot-shaped, colored light sources in the form of light emitting diodes.

18 Claims, 2 Drawing Sheets

TRAFFIC CONTROL DEVICE FOR STREET VEHICLES

BACKGROUND OF THE INVENTION

The invention relates to a control device for vehicular street traffic including at least one signal disc serving as an optical signalling device which can be covered by pivotal slats fastened to a frame.

The invention is useful specifically for traffic lights which control street traffic with the aid of two or three colored signals.

The current consumption of traffic lights, whose optical signalling devices are usually equipped with incandescent bulbs having a power consumption of 75 to 100 Watts, is considerable. If is assumed that the connected load of the traffic light system of a customary street intersection is about 2 to 3.5 kilowatts and, if operation of 16 hours per day is assumed, such a system consumes about 15,000 kilowatt hours of electrical energy per year. This corresponds to the annual consumption of heating for a well insulated single family home.

In the prior art traffic lights, due to the poor efficiency of the incandescent bulbs employed, only a very small portion of the energy consumed is converted to lighting power. Due to their delayed response, fluorescent bulbs—which are more efficient—cannot replace incandescent bulbs. Another drawback is that the visibility of the signals of the prior art traffic lights is poor unless the observer is located precisely within the relatively narrow cone of the bundled green, yellow or red light being sent out. From a side position or in strong sunlight, the signalling devices are often discernible with difficulty or not at all. However, an increase in light intensity must be kept within limits otherwise the light would be blinding at night.

A variable traffic sign is known which includes a signal disc equipped with lettering which can be covered by horizontally placed, pivotal slats (U.S. Pat. No. 3,553,645). The drawback of this arrangement is that the signal disc or, more precisely, the lettering on the disc, is shaded against daylight when the horizontally disposed slats are open. If the light is viewed in close proximity at as steep angle from the ground, the signal disc is inevitably almost completely covered by the slats so that the lettering can no longer be seen. For this reason, therefore, signalling devices equipped with slats have not been used in the past for traffic control.

SUMMARY OF THE INVENTION

It is the object of the invention to improve the visibility of the signal disc of a signalling device equipped with pivotal slats.

To solve the problem of the prior art the invention employs a control device for vehicular street traffic which is equipped with at least one signal disc serving as an optical signalling device which can be covered by pivotal slats fastened to a frame and solves the problem in that the signal disc is provided with parallel signal webs separated by grooves; the pivotal slats are arranged parallel to the grooves, with the pivot axes of the slats lying in one of their longitudinal edges and in the planes of the grooves; the width of the slats coincides with the width of the signal webs and corresponds to the depth of the grooves; and the signal disc as well as the frame can be displaced or are movable relative to one another by the width of the slats, with the displacement or movement causing the slats to pivot into the plane of the grooves and to push themselves into the grooves. A signal disc having these features can be seen without obstruction from every angle and permits signalling with the least energy consumption solely by means of the faces of the signal webs which, for example, are covered by the slats or exposed in the rhythm of the phase duration of a traffic light system.

It is advisable that the frame has the shape of a fixed frame. It is enclosed all around and the signal disc is moveable.

A displacment device engages at the signal disc.

Advantageously, a switchable electric motor equipped with a threaded spindle serves as the displacement device.

The signal disc may be produced of a thin-walled material and may have a meander-shaped cross section.

Advantageously, the signal discs are provided with colored coatings which serve to signal the various phases of the street traffic.

Advantageously, the colored coatings may be composed of a persistant color.

In a first embodiment, the signal disc is composed of an opaque material. According to a second embodiment, the signal disc may, however, also be composed of a partially transparent material, with at least one light bulb then being disposed behind the signal disc. Since this light bulb may be turned on permanently, a fluorescent bulb is preferred here.

Advantageously, the cover faces of the slats are provided with a light absorbing coating so that, in their position in which they cover the signal webs, the slats appear as a black surface.

According to a further feature of the invention, light sources are disposed in the webs of the signal disc. These light sources serve as signalling devices at dusk or during the night.

In order to permit the signal disc to be seen well not only from the front but also from the side and from below, the axes of the light sources are oriented so as to diverge.

Light emitting diodes are preferably employed as light sources.

To reliably pivot the slats back in front of the signal webs, a reset device may engage at the slats.

It is advisable to use a tension element engaging at the slats to serve as the reset device.

The tension element may be under the influence of a spring element.

In another embodiment of the reset device, a pivot lever is provided at each slat to engage a rail that is movable transversely to the slats and is actuated by a lifting magnet.

To prevent freezing of the mechanism of the device in winter, a heating device may be provided at the signal disc.

BRIEF DESCRIPTION OF THE DRAWINGS

One embodiment of the described control device for vehicular street traffic is shown in the attached drawing figures which will now be described in greater detail. The drawing figures show in.

DESCRIPTION OF THE PREFERRED EMBODIMENTS

Figure 1:
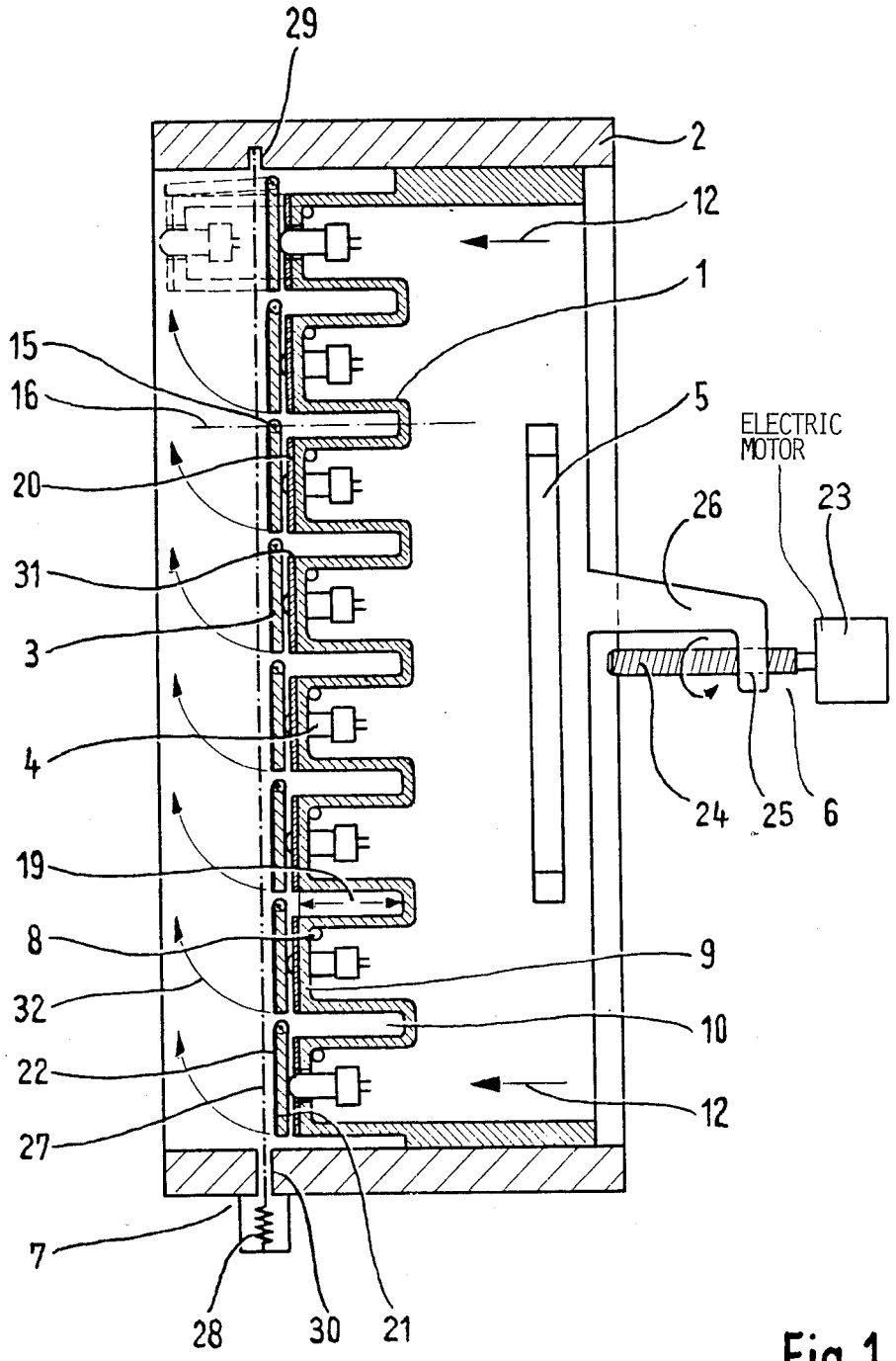
FIG. 1 is a cross section view of a traffic control device.

The device illustrated in the drawing figures is, as shown in FIG. 1, a signal disc 1, a frame 2, a number of slats 3, a plurality of light sources 4, a light bulb 5, a displacement device 6, a reset device 7 and a heating device 8.

Signal disc 1 is composed of compression molded, thermoplastic or duroplastic material and has a meandershaped cross section. The signal disc 1 is provided with parallel signal webs 9 of identical width which are separated by narrow, parallel grooves 10 of identical depth.

Figure 2:
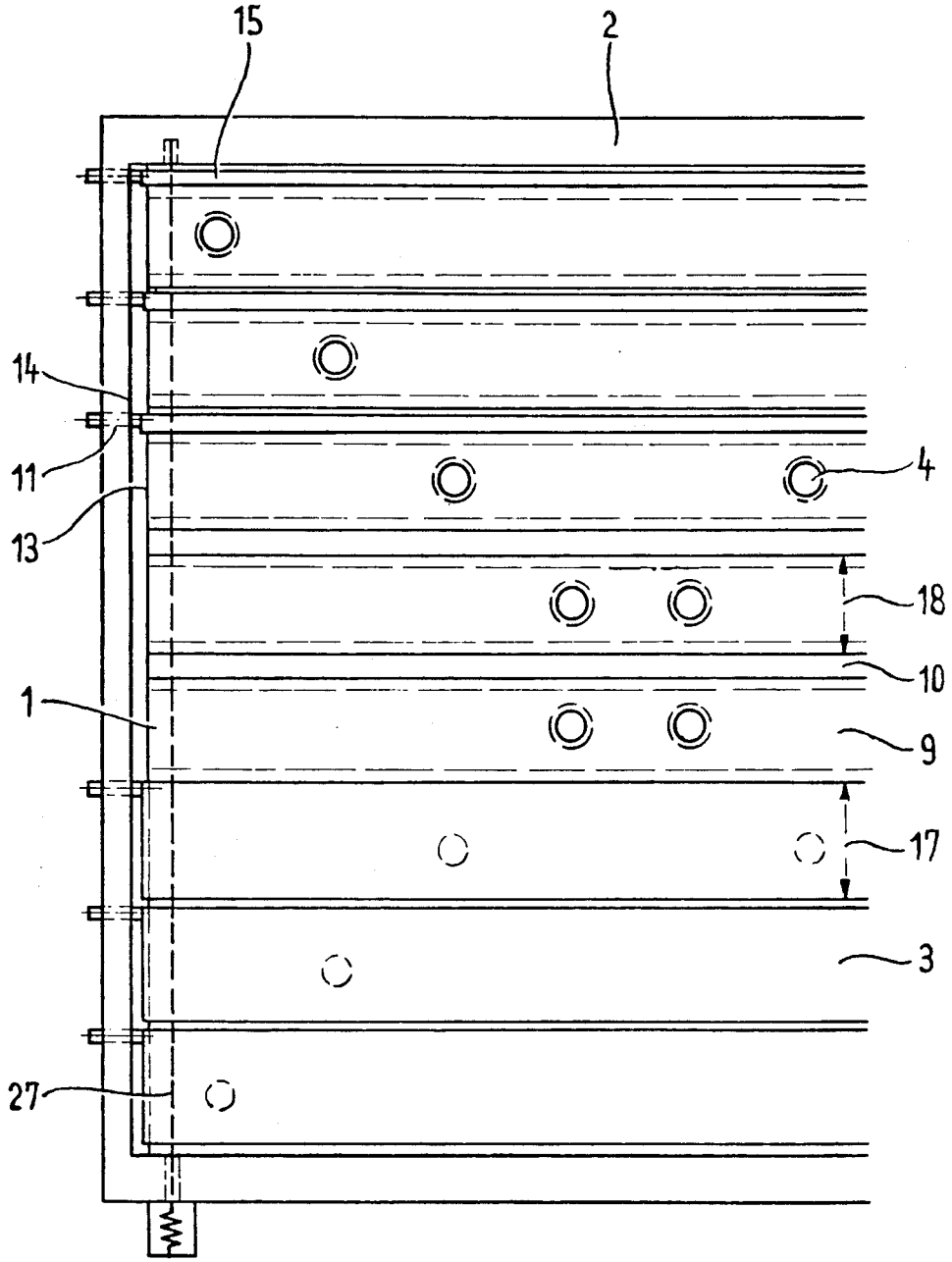
FIG. 2 is a partial frontal view of the device according to FIG. 1 showing the upper three slats pivoted into the grooves, two slats being omitted in the center and three slats at the bottom being disposed in front of the respective signal webs of the signal disc.

Frame 2 has the shape of a square frame closed all around and is likewise made of a suitable compression molded plastic. At each of two opposite sides, this frame 2 is provided with a row of passage holes 11, as shown in FIG. 2. Signal disc 1 is arranged in frame 2 so as to be movable or displaced in the direction of the two arrows 12. Instead of a square frame, a circular ring-shaped frame could be used just as well.

Slats 3 are arranged to be pivotal in frame 2 and are provided on both sides of their narrow sides 13 with projecting shaft stubs 14 which are mounted in the passage holes 11 of frame 2. The pivot axes 15 of slats 3 lie in the upper longitudinal edges of slats 3 and the latter are arranged in such a manner that pivot axes 15 lie in planes 16 of grooves 10.

The width 17, as shown in FIG. 2 of slats 3 coincides with the width 18 of signal webs 9 and also corresponds to the depth 19 of grooves 10.

Slats 3 are arranged parallel to grooves 10 in the signal disc 1 and completely cover its signal webs 9.

Signal webs 9 of the signal disc 1 are equipped with diffusely reflecting color coatings 20 composed of a persistent color. The cover faces 21 of the slats 3 are provided with a light absorbing coating 22.

Dot-shaped light sources 4 are seated in the signal webs 9 of the signal disc 1. These light sources are light emitting diodes which emit green, yellow or red light. These light sources 4 as shown in FIG. 2 are arranged on signal disc 1 in the shape of a cross. The axes of these light sources 4 may be oriented so as to diverge, i.e. offset at an angle so that the signal disc 1 can also be seen well from the side.

Signal disc 1 may be made of a partially transparent material dyed green, yellow or red. In this case, a light bulb 5, possibly a small fluorescent bulb, is attached behind signal disc 1.

Signal disc 1 is movable or displaced with respect to stationary frame 2 by the width 17 of the slats 3. To effect the movement or displacement, a displacement device 6 composed of a switchable electric motor 23 and a threaded spindle 24 engages at the signal disc 1. Threaded spindle 24 rotates in the thread 25 of a holding arm 26 projecting from the signal disc 1. A lifting magnet may also serve as the displacement device 6. To improve the guidance of the signal disc 1 in the frame 2 during displacement, cylindrical pins are provided in frame 2 which are moveable or displaced in sleeves disposed at the signal disc 1 for reasons of improving clarity, this guide is not shown in the drawing figures.

Reset device 7 for the slats 3 is composed of a tension element 27 which is under the influence of a spring element 28 in the form of a tension spring. Tension element 27 for example a tension band or a cable, fastened in a blind bore 29 in the frame 2 has tension applied to it by tension element 27 and lies in front of the slats 3 passing through a hole 30 in frame 2 and attached to the tension element 27.

Heating element 8 in the form of rod-shaped heating elements is provided at the rear of the signal webs 9 of the signal disc 1.

The device operates as follows.

As long as no signal is produced, the signal disc 1 is in its rearward position (as shown in FIG. 1) and the slats 3 hang down vertically so as to completely cover the signal webs 9. The outwardly oriented cover faces 21 of the slats 3 form a closed surface in front of the signal disc 1. Due to the light-absorbing coating 22, this surface appears completely black.

To produce a signal, the electric motor 23 is provided with a current to rotate threaded spindle 24 which shifts the disc 1 into its forward position (as shown by dashed lines at the upper left of FIG. 1). This movement is accomplished by moving the signal disc relative to the frame, i.e. either by moving the signal disc while maintaining the frame stationary or by moving the frame while maintaining the signal disc stationary. This causes the upper edges 31 of the signal webs 9 to be pushed from the rear against the slats 3 which are pivoted in the direction of arrows 32 into the the plane 16 of the grooves 10 and push themselves into the grooves 10 where they disappear almost completely. Thus, the colored coatings 20 of the signal webs 9 are exposed and, depending on their color, green/yellow/red, give the signal "Go", "Caution" or "Stop."

At dusk or in darkness, the signals are given additionally or entirely by light sources 4 of a corresponding color disposed in signal webs 9. Alternatively, if signal disc 1 is transparent, by a light bulb 5 behind it which remains permanently turned on.

I claim:

1. A control device with a frame for vehicular street traffic, said control device having at least one signal disc serving as an optical signalling device and a plurality of pivotal slats with widths, and said slats being fastened to said frame for covering said optical signalling device, comprising:

parallel signal webs mounted to said signal disc and each said web being separated by a groove;

said pivotal slats being initially arranged perpendicular to each said groove with a pivot axis of said each slat lying in a longitudinal edge of said slat and in a plane being defined by said grooves;

said width of each of said slats approximately coinciding with a width of each said signal web and substantially corresponding to a depth of each said groove; and said signal disc and said frame being moveable relative to one another by said width of said slats, with movement causing said slats to pivot into said planes of said grooves and be pushed into said grooves.

2. A device according to claim 1, wherein said frame is stationary and encloses said control device with said signal disc being moveable inside said stationary frame.

3. A device according to claim 1, comprising a displacement device for engaging said signal disc.

4. A device according to claim 3, wherein said displacement device is a switchable electric motor being equipped with a theaded spindle.

5. A device according to claim 1, wherein said signal disc has a meander-shaped cross section.

6. A device according to claim 1, wherein said signal webs are provided with colored coatings.

7. A device according to claim 6, wherein said colored coatings of said signal webs have a persistent color.

8. A device according to claim 1, wherein said signal disc has a partially transparent material; and at least one light bulb being disposed behind said signal disc.

9. A device according to claim 8, wherein said light bulb being a fluorescent bulb.

10. A device according to claim 1, wherein said slats have cover faces which are provided with a light absorbing coating.

11. A device according to claim 1, comprising a plurality of light sources are disposed in said signal webs of said signal disc.

12. A device according to claim 11, wherein said light sources have axes being oriented so as to diverge.

13. A device according to claim 11, wherein said light sources are light emitting diodes.

14. A device according to claim 1, comprising a reset device for engaging said slats.

15. A device according to claim 14, wherein said reset device includes a tension element for engaging said slats.

16. A device according to claim 15, comprising a spring element for influencing said tension element.

17. A device according to claim 1, wherein said signal disc includes a heating device attached thereto.

18. A device according to claim 1, wherein said signal disc is stationary and said frame is moveable.

* * * * *